United States Patent [19]

Hyde

[11] 4,032,671

[45] June 28, 1977

[54] METHOD OF FORMING ART PRODUCT

[76] Inventor: Robert W. Hyde, Rte. 1, Box 236, Crystal River, Fla. 32629

[22] Filed: June 28, 1976

[21] Appl. No.: 700,165

[52] U.S. Cl. ..... 427/14

[51] Int. Cl.[2] ..... B05D 1/36; B05D 1/38; B05D 3/14; B05D 5/06

[58] Field of Search ..... 427/14

[56] References Cited

UNITED STATES PATENTS

| | | | |
|---|---|---|---|
| 1,784,912 | 12/1930 | Scott | 427/14 X |
| 3,504,625 | 4/1970 | Childress | 427/14 X |
| 3,557,691 | 1/1971 | Bayer | 427/14 X |

*Primary Examiner*—James R. Hoffman

*Attorney, Agent, or Firm*—Duckworth, Hobby, Orman, Allen & Pettis

[57] ABSTRACT

A process for forming an art product and a package assembly for containing the art product. The art product having an arbitrary arranged pattern of inks or pigmented materials thereon and including one or more intermixed colors wherein the ink or pigmented material is capable of being responsive to an electrostatic charge. The process includes forming ionic patterns on at least one surface of a plate capable of bearing an electrostatic charge and applying one or more of the electroresponsive inks to the formed ionic pattern. The ink can be transferred to the pattern from a brush or like source disposed either in spaced relation to the surface of the charge plate or in direct contact therewith. The package assembly also includes structure capable of supporting and exposing the charge plate during application of the process as well as containing the materials for performing the process and the art product itself.

18 Claims, 14 Drawing Figures

FIG. 1
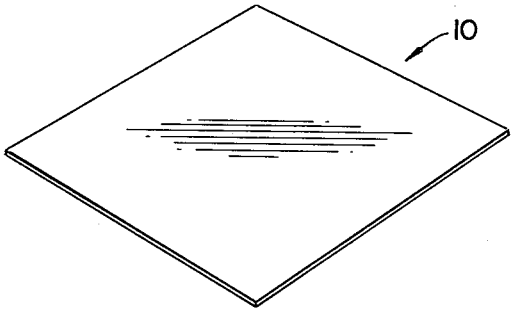
FIG. 2
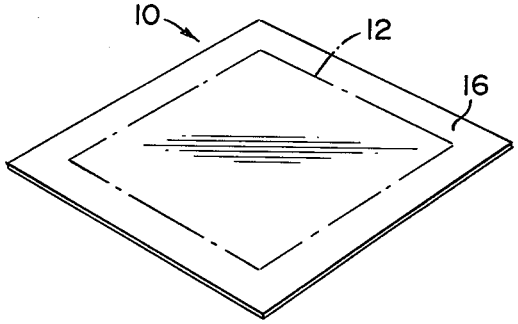
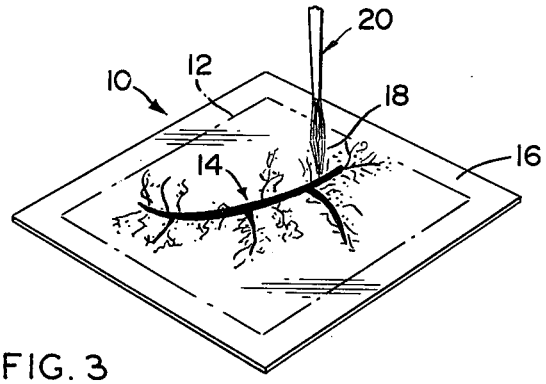
FIG. 3
FIG. 6
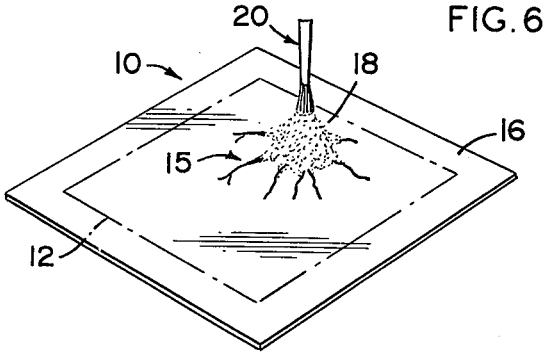
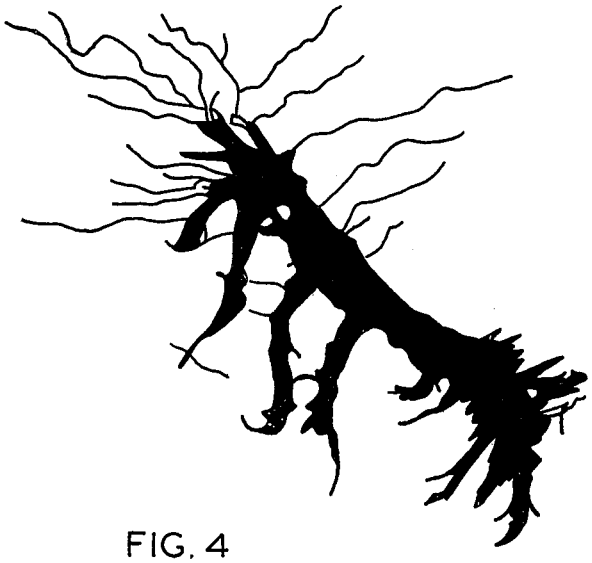
FIG. 4
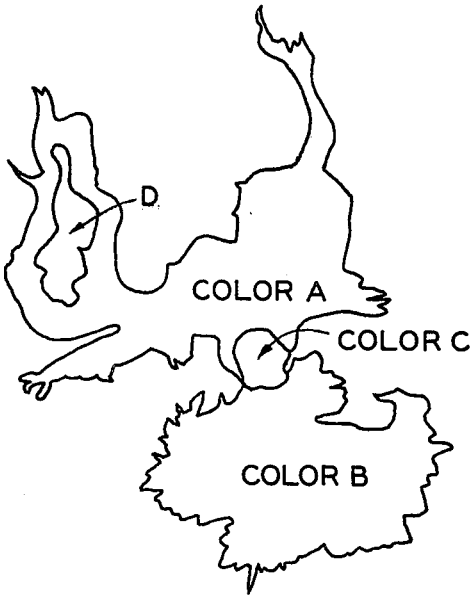
FIG. 5

METHOD OF FORMING ART PRODUCT

BACKGROUND OF THE INVENTION

1. Field of the Invention

This invention relates to a package assembly for containing an art product and a process of forming a plurality of random, arbitrarily defined patterns through the use of an elecrostatic charge placed on a chargeable plate in a manner to define certain ionic patterns which are accented by a pigment bearing material which is electroresponsive ink or the like.

2. Description of the Prior Art

Numerous art forms have been developed and are now currently in existence. Art per se has, of course, existed since the earliest days of recorded history. The creating of certain art forms originated with man's attempt to communicate and/or record events for posterity. With the advent of the written and published word, art forms have varied increasingly and yet maintained a popular and lasting position in society. While certain of these art forms such as paintings, sculpting, and, in more modern times, photography, have become classic examples of artistic creation, various other forms have come into existance due to man's ever increasing technology in various fields. Obviously, art has continued to flourish due to the continued increase of modern man's leisure time. Numerous people have turned to the development of artistic endeavors in order to utilize this additional free time now available. Such free time has frequently resulted in the development of handicraft kits when various types of activity can be practiced by a wide number of relatively unskilled people. Aesthetically pleasing or otherwise desirable end products in various forms have been the result. In order to be popular, handicraft kit type artistic forms should be relatively inexpensive, both upon initial purchase and to maintain, and also should produce an effective aesthetically pleasing end product. Accomplishment of completed end products should occur with a minimum of developed skill so as to be available to the widest number of people. The end product should therefore be able to be produced efficiently without requiring great amounts of time. In addition, the desirable features of modern day leisure type art forms should include end products which are aesthetically pleasing and adaptable to a number of applications including amateur, professional and certain types of commercial applications.

Especially when dealing with handicraft type kits the packaging assembly utilized for such art forms could also add to the desirability. Such packaging assembly could be adaptable for use as support or working platforms in the application of the processes utilized in forming the end product. The commercial success or "saleability" of many products including handicraft kits is frequently attributed to successful packaging design. The utilitarian feature of any package design in performing the process for which the kit was developed could also lead to the desirability and popularity of such kits.

SUMMARY OF THE INVENTION

This invention relates to the process of forming an art product comprising an artistic display as well as a packaging assembly for containing the display which is also adaptable to be used as a work or supporting facility. The display includes an arbitrary defined pattern of one or more pigment bearing materials applied to a plate. Alternately a plurality of contiguously or overlapping patterns aesthetically arranged relative to one another in an arbitrary but aesthetically pleasing fashion defines the art product.

The process for forming the end product includes forming a sheet or plate into a desired configuration and placing an electrostatic charge on this plate. The charge is applied by frictional engagement of one or more of the surfaces of the plate with a plurality of other such plates (sliding engagement between the plates). Placing of the electrostatic charge of the plate makes it adherent to the pigment material which preferably comprises ink which is responsive to an electrostatic charge or like material capable of being "electroresponsive."

For the purpose of clarity the term electroresponsive shall mean, for the purpose of disclosure of the present invention, the characteristic of being capable of carrying an electrostatic charge. Therefore an electroresponsive ink will react or respond to an electrostatic charge on a plate. The ink per se does not have to be carrying a charge itself but it could be conductive. A number of such inks or pigment bearing materials are commercially available and which are capable of displaying this characteristic.

Varied methods may be utilized in the placing of the electrostatic charge on the plate such as rubbing either of the opposed surfaces of the plate with animal fur or applicable cloth material, wherein the material itself is capable of bearing an electrostatic charge. It should be pointed out that the two specific techniques set forth above for forming the electrostatic charge should be considered to be representative only and not the sole means of forming such a charge. However, the above two means may very well be considered part of the preferred embodiment and will be explained in greater detail hereinafter.

When the electrostatic charge is formed on the plate, certain ionic patterns are formed on the various areas of the plate. The subsequent introduction of electroconductive inks or paint to this ionic pattern causes the ink to clearly define the pattern by adhering thereto. The ionic pattern will therefore be apparent to the eye. The method of application and/or quantity and conductive characteristics of the ink or conductive material may effect what portion of the ionic pattern the ink follows. This in turn adds to the variety and accordingly the desirability of the process in forming the aesthetic display.

A source for the application of the electroresponsive ink may take the form of a brush or like instrument. In one embodiment the brush is positioned a spaced distance from the charge plate. Due to the electroresponsive characteristics of the ink and the ionic pattern defined on the plate, electrostatic attraction will force the ink off the brush onto the spaced apart surface of the plate. When directly applied to this surface plate, the ink will automatically flow along portions of the ionic pattern due to the electrostatic attraction.

Different inks each having different colors may be applied either simultaneously or individually to form a mixture of colors and a variety of patterns. Such inks may be placed in adjacent or alternately overlapping relation to one another in order to add variety to the patterns formed.

Yet another embodiment of the present invention comprises the application of solvents which may include any material capable of reorganizing the ink or like material on the surface of the plate. In application, the solvent is placed on a pattern already having the charged ink positioned thereon. The solvent, of course, serves to dislodge the formed ink thereby rearranging the charged ink on the ionic pattern and causing a new pattern having a variety of aesthetic appearances. In addition, the plate may be maintained in constant motion during the application of either the solvent or one or more of the inks. Also constant frictional engagement or rubbing of the plate with animal fur, cloth, or the like during application of either the solvent or the electroresponsive ink also causes a variety of patterns and a constant relocation of the ink along different portions of the pattern or the newly formed pattern formed by the simultaneous "charging" of the plate.

The plate itself may be formed from a plastic material and be opaque, translucent or transparent. The electroconductive charge may be formed on the plate either by rubbing the surface of the plate on which the pigment or ink is to be placed or the oppositely disposed surface therefrom. Also a "charging plate" of substantially greater thickness may underlie the plate being charged when the plate is in the form of a thin transparent film. A substantially greater electrostatic charge will be transferred to the adjacently positioned "thin film" plate.

Yet another feature of the present invention comprises the provision of a package assembly including a first and second package portion each having a base and each having a wall means formed thereon and extending outwardly from the base. One of the first or second package portions has its wall means correspondingly configured and positioned relative to the other so as to accomplish a telescopic relation when the wall means of each of the two portions slidingly engage one another. This defines a closed interior in which the various supplies used to form the process, ink, paint, plates, etc., may be packaged.

During performance of the process or method of forming the ionic patterns, one of the plates may be disposed in a window formed in both of the two package portions. To accomplish this the plate is specifically configured and dimensioned to be positioned contiguous to such a formed window such that a major surface portion thereof is exposed to the exterior thereof.

In addition, certain access means in the form of one aperture is formed in the side wall of the wall means. Each wall means of each portion thereby has a side wall portion with an aperture integrally formed therein. When the apertures are arranged in aligned, overlapping relation to one another, clear access is provided to the interior by the hand of one performing the process. Therefore, in one embodiment of the present invention a plate to be charged is placed adjacent an upstanding package portion such that a major surface portion is exposed to the window formed therein. The other package portion is placed inside the outer package portion such that the windows therein are placed in aligned relation to one another. In this disposition the under surface of the plate is positioned adjacent and in exposed relation to the window of the under package portion. The upper package portion is positioned such that its window is exposed to the upper surface of the plate. The two integrally formed apertures in the side wall portions of the wall means of each portion are aligned so that the hand of the user of the process may enter the interior of the package assembly and rub the underside of the plate through the window in the under package portion thereby placing a charge thereon. This charge may be applied either simultaneously, prior, or subsequent to the application of the electroresponsive ink to the exposed surface of the plate through the window formed in the upper package portion.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the plate on which an ionic pattern may be formed.

FIG. 2 is a perspective view with the ionic pattern formed from an electrostatic field represented in broken lines thereon.

FIG. 3 is a perspective view of a charge sheet having conductive pigment bearing material applied thereto.

FIG. 4 is a representative ionic pattern emphasized by the conductive ink being applied thereto.

FIG. 5 is yet another embodiment of a possible ionic pattern which has been emphasized by conductive ink or paint.

FIG. 6 is yet another embodiment showing a pattern formed by applying the conductive ink from a brush or like source instrument disposed in spaced relation to the surface which has been charged.

FIG. 12 is an exploded view showing the upper and under package portions in supporting position relative to the plate to be worked on.

Similar reference characters refer to similar parts throughout the several views of the drawings.

DETAILED DESCRIPTION

Figure 7:
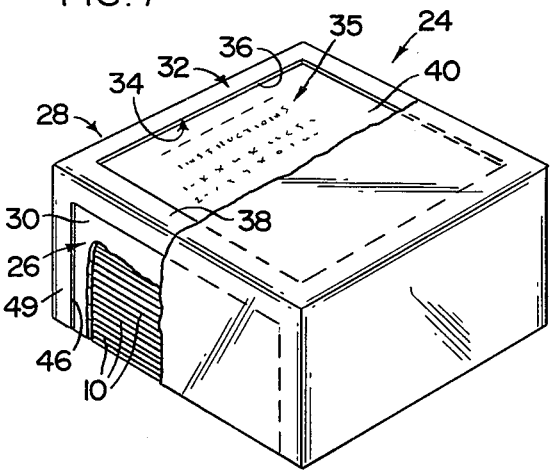
FIG. 7 is a perspective view in partial cutaway of the package assembly of the present invention.

As represented in FIGS. 1–3, the subject invention includes an art product defined by utilizing a plate, generally indicated as 10. The term plate is herein meant to define any sheet type structure including a film of chargeable material. The plate 10 may be made from a plastic or like material and may be transparent, translucent or opaque dependent upon the desires of the operator wherein the material is capable of maintaining an electrostatic charge thereon.

The plate 10 therefore contains an electrostatic charge thereon generally indicated as 12 by a broken line. This charge serves to define an ionic pattern being formed on one or more surfaces of the plate 10. The electrostatic charge will be visually defined by a plurality of arbitrary and intricate pattern components. This arbitrary pattern arrangement in combination with the conductive ink provides the aesthetically pleasing properties of the resulting end product. The charge is placed on a given surface of plate 10 by rubbing the plate with an applicable material itself being capable of having an electrostatic charge formed thereon. Continued frictional engagement between such material and the plate, through rubbing, will result in a charge being placed thereon. The resulting formed electrostatic charge will therefore be present both on the surface actually being rubbed as well as the oppositely disposed surface, of course, dependent upon the thickness of the plate being utilized.

Other means of forming the charge on the plate includes frictional engagement with the other plates by sliding contact of the one plate with the other plates when the other plates are arranged in a stacked array. Such sliding contact occurs by removing a plate from the stacked array or pile. Of course, other types of sliding engagement may occur with the same type desired results.

FIG. 3 depicts one pattern generally indicated as 14 being formed by positioning a source 20 of electroresponsive ink in direct contact with the surface 16 on which the charge 12 has been placed. The natural attraction between the ink 18 and the charged surface 16 will cause the ink 18 to flow along the ionic pattern 12 from the source 20. While the source 20 is generally indicated as being a brush having the ink 18 applied thereto it should be readily apparent that any instrument could serve as a supply or source of the ink 18. In addition, it should be obvious that the ink or conductive paint could otherwise be applied directly to the surface 16 by means other than a brush like instrument. The pattern 14 is the result of application of the ink when the brush or source 20 is in direct contact with the surface.

As shown in FIG. 6, an alternate embodiment of the present invention comprises the source 20 being disposed in spaced relation to the surface 16 of the plate 10. When the ink 18 passes or "jumps" from the brush or source 20 to the surfaces 16, the pattern 15 is formed. This pattern differs somewhat from that shown in the embodiment shown in FIG. 3. Passage or "jumping" of the conductive ink 18 occurs due to the electrostatic attraction based on the charge being placed on the plate 10 or surfaces 16 and the fact that the ink 18 itself is conductive. The amount of spacing between the brush 20 and the surface 16 may be varied and this varied space may in turn determine the arbitrariness or differences in the resulting pattern 15.

The pattern shown in FIG. 4 is representative of various types of pattern components or portions which may be formed by a conductive ink being transmitted throughout the ionic pattern formed by the electrostatic charge on a plate. Again, the specific pattern defined and its aesthetic appearance is dependent on the charge plate 10 and the manner in which the ink 18 is placed thereon. These differences are represented by the variation in appearances of the patterns of the various embodiments shown in FIGS. 3, 4 and 6.

With regard to FIG. 5 an aesthetic pattern may be formed utilizing a plurality of inks each of which may be of a different color. More specifically, color A and color B represent different pigments disposed, at least in part, in adjacent or contiguous relation to one another. The pattern again may be varied by overlapping the pigment as shown by color C which results from a combination of color A and color B. This may occur by first charging the surface, applying an ink or pigment to the charged surface to define a pattern portion of the component (color A). Subsequently the color B or the pigment containing color B may be applied either prior to, simultaneously to or subsequent to the recharging of the surface or plate on which the color B is placed. The surface can be recharged a third time when color B is placed in overlapping relation to color A to form a third color C. Again this overlapping relation may be disposed simultaneously to, prior to or subsequent to the recharging of the surface of the plate.

Yet another embodiment of the present invention is represented in FIG. 5 and includes adding a solvent material D to one of the pigments (color A) already positioned on the charged surface. The solvent serves to relocate or displace the dried or already formed pigment present on a charged surface. The solvent may be applied to the surface also during recharging, prior to or subsequent to recharging in order to get a varied and desired pattern. Constant motion of the plate during application of either of the pigments and the solvent may again serve to add yet another variety of pattern and therefore aesthetic appearance of the resulting end product.

Figure 8:
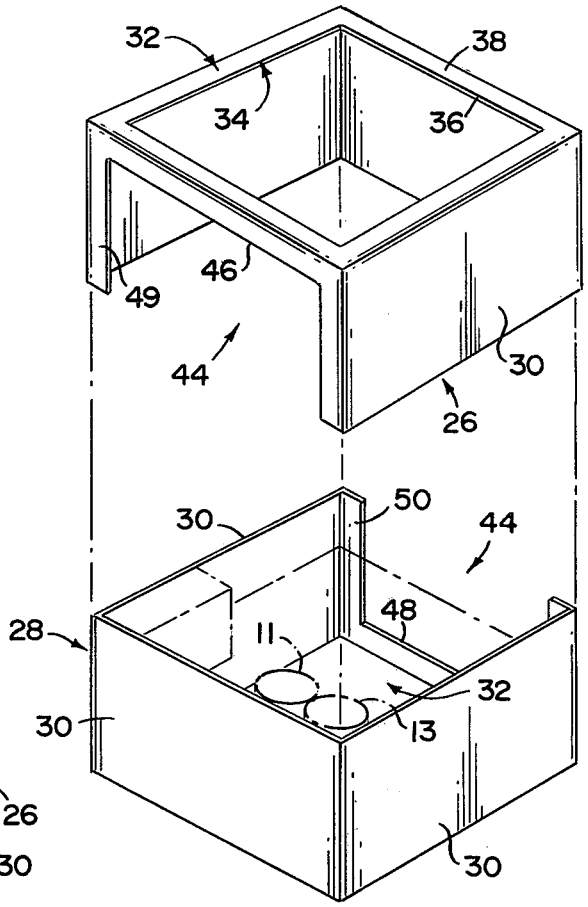
FIG. 8 is an exploded view of the various components comprising the package assembly.

With regard to FIGs. 7–11 the process may be applied utilizing the plate of the subject invention through a combination package assembly and supporting work platform generally indicated as 24. With reference to FIG. 8 the package assembly 24 comprises a first package portion 26 and a second package portion generally indicated as 28. Each of the container portions 26 and 28 comprises wall means 30 and a base 32 wherein the wall means 30 extend outwardly or in perpendicular relation to the base 32. The configuration and dimension of the wall means 30 are such to be disposed in telescopic relation to one another when the two portions 26 and 28 define a closed position as represented in FIG. 7. This closed position would be the result of the engagement of the two portions 26 and 28 from their exploded view as represented in FIG. 8.

Figure 9:
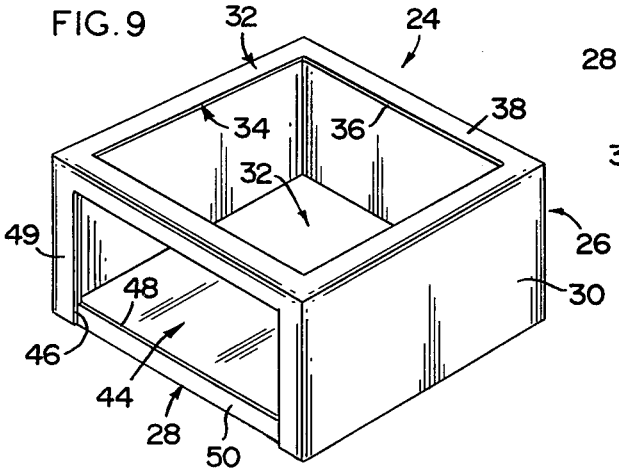
FIG. 9 is a perspective view of one portion, showing the interior of the package assembly.
Figure 10:
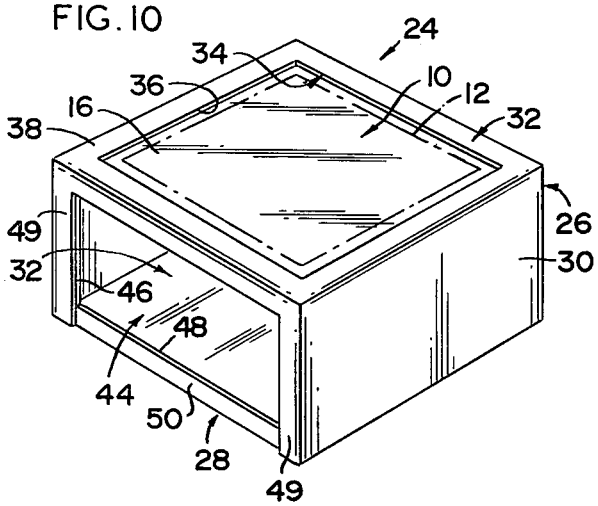
FIG. 10 is a perspective view of the package assembly disposed to function as a work or support platform having a plate connected thereto.

As shown in FIGS. 8, 9 and 10 at least one, and preferably both of the portions 26 and 28 comprises a window means generally indicated as 34 defined by a window opening 36 integrally formed in the base of both of the portions 26 or 28. A surrounding peripheral flange 38 is disposed in surrounding relation to the window opening 36 and defines its boundaries.

Figure 11:
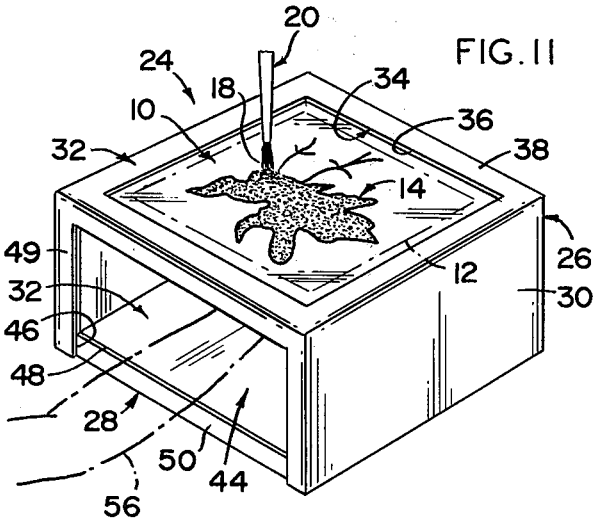
FIG. 11 is a perspective view of the package assembly as a support or work platform with the conductive ink being applied to a plate supported thereon.

As shown in FIG. 11 the plate generally indicated as 10 is specifically designed, dimensioned and configured to be disposed adjacent to the window 34 such that a major surface portion 16 thereof may be exposed to the exterior. Similarly, with regard to FIG. 7 a supporting plate 40 may be used to fill the window 34 and present advertising media or indicia 35 to the exterior of the container or plastic assembly 28 while the plate 10 and other parts of the kit 11 and 13 are contained therein.

Additional structural features of the present invention include an access means generally indicated as 44 which is defined by a first aperture 46 formed in the portion 26 and a second aperture 48 formed in the portion 28. Each of these apertures are of substantially corresponding design, dimension and configuration and are formed in corresponding side walls 49 and 50, respectively, in the wall means 30.

The closed position of the package assembly 28 has the apertures 46 and 48 out of alignment and out of overlapping relation to one another such that the space within the closed two portions 26 and 28 does not have open access thereto. This particular position is represented by the embodiment of FIG. 1. To the contrary when the apertures 46 and 48 (FIG. 9) are in aligned, overlapping relation to one another such that the corresponding wall portions 49 and 50 are disposed in side by side relation to one another clear access is provided to the interior of the package portions 26 and 28 by an arm or hand 56 (FIG. 11) for reasons to be explained in greater detail hereinafter.

In operation, the plate 10 is placed in the window opening so as to expose surface 16 through the window opening 36. An electrostatic charge is placed on the plate 10 by rubbing fur, cloth or applicable material by an arm 56 as generally represented in FIG. 11. Simultaneous to this the ink 18 may be applied to the charged surface 16 by the brush or source 20 so as to simultaneously form the charged ink on the ionic pattern 14 as shown in FIG. 11.

Upon completion of the process the two portions 26 and 28 may be realigned to the position or disposition as shown in FIGS. 7 and 8 so as to again provide an enclosed package wherein the support plate 40 fills the window aperture 36.

Figure 12:
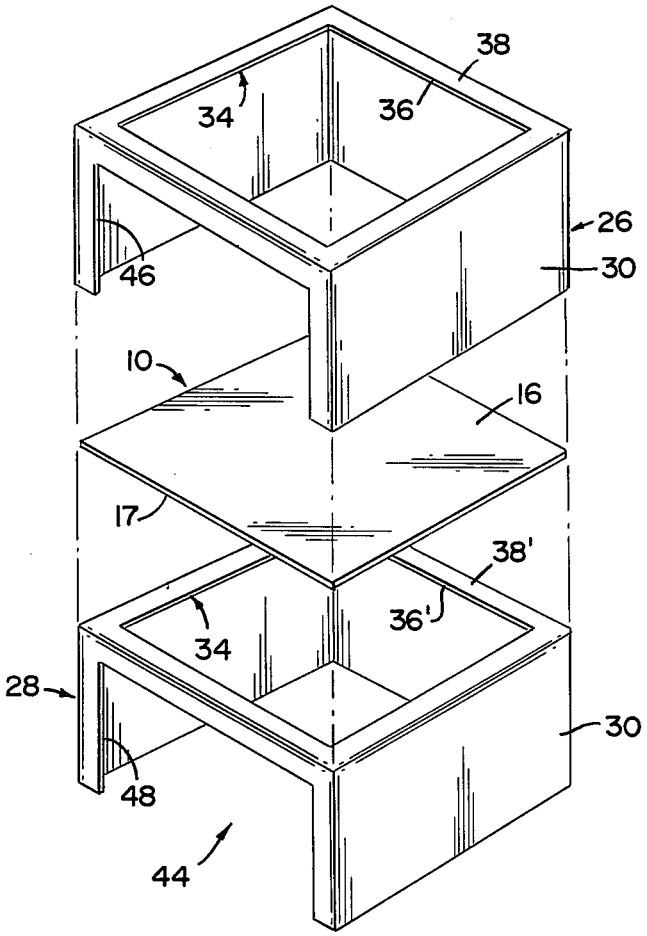
Figure 13:
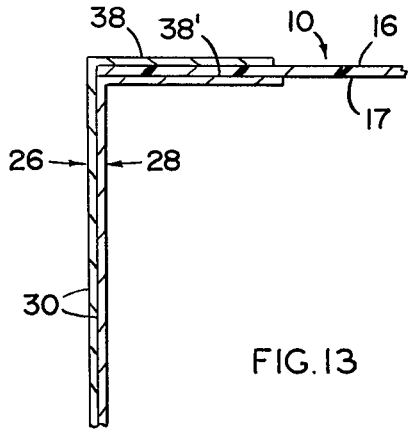
FIG. 13 is a partial, cutaway view in section showing the relative positions of the inner and outer package portions.
Figure 14:
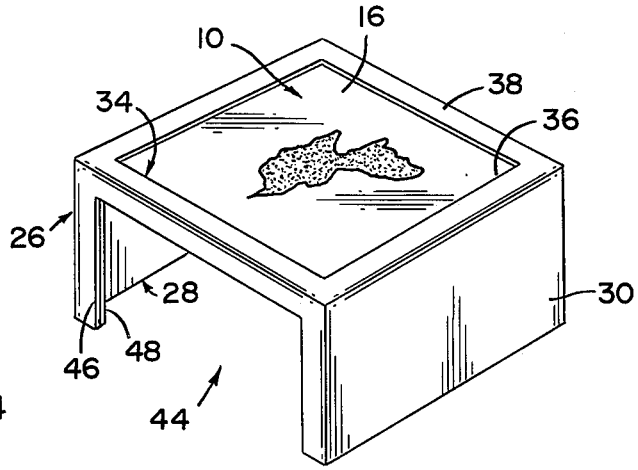
FIG. 14 is a perspective view showing the "close" or operative supporting position of the inner and outer package portions of the embodiment of FIG. 12.

With regard to FIGS. 12, 13 and 14, plate 10 may be supported with the use of both package portions 26 and 28 by inverting the disposition of package portion 28 as shown in FIG. 12 and placing it inside the interior package portion 26. In this position its window 36′ is disposed in aligned relation to the window 36 of package portion 26. Therefore, both the surfaces 16 and 17 (FIG. 13) of the plate 10 are disposed. More specifically, the under surface 17 is exposed through the access means 44 formed by the aligned relation of the aperture 48 and aperture 46 (FIGS. 12 and 14). The arm or hand of the user of the process is merely inserted in this aperture means so as to provide access and rubbing of the under surface 17 of the plate 10. Charging of the plate thereby results. The ink is applied to surface 16 by exposure of this surface through the window 36 of the upper or outer package portion 26 as clearly represented in these figures. As shown in FIG. 12, the peripheral flange 38′ serves to support the plate 10 by engagement with the peripheral portion of the under surface 17. When supported in this fashion the plate 10 is thereby positioned in a sandwich like relation between the package portion 28 on the interior of the package portion 26.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method of producing a display item comprising the steps of:
   a. forming a plate for said display item from a material capable of bearing an electrostatic charge;
   b. applying a liquid electroresponsive pigment bearing material to a surface of said plate;
   c. placing an electrostatic charge on said plate;
   d. allowing said material to disperse on said surface in response to said charge; and
   e. drying said dispersed material on said plate.

2. A method as in claim 1 comprising: forming said plate from a plastic material capable of bearing an electrostatic charge.

3. A method as in claim 1 comprising forming the electrostatic charge on said plate by repeatedly rubbing a surface thereof with an animal fur capable itself of bearing an electrostatic charge.

4. A method as in claim 1 further comprising forming the electrostatic charge on a surface of said plate by movably engaging the surface with adjacently disposed surfaces of adjacently disposed plates.

5. A method as in claim 1 further comprising packaging the display item in a package assembly, wherein said package assembly comprises: a first and second package portion each including a base and wall means extending outwardly from said base, said wall means of each package portion dimensioned and configured to engage the other package portion and define, at least in part, an enclosed container for said display item.

6. A method as in claim 5 wherein at least one of said package portions comprises window means formed in said base and including a window opening dimensioned and configured to expose a major surface portion of the plate when disposed in adjacent relation thereto.

7. A method as in claim 6 wherein each of said package portions comprise window means formed in said respective base and each window means includes a window opening dimensioned and configured to expose an oppositely disposed major surface portion of a common plate when said package portions are disposed in corresponding, telescopic relation to one another.

8. A method as in claim 5 wherein said wall means of said first package portion are dimensioned and configured for disposition in enclosed, overlapping relation to the wall means of said second package portion, wherein said wall means of said first package portion are disposed in closing, telescoping relation to the wall means of said second package portion.

9. A method as in claim 5 further including access means comprising an aperture integrally formed in one side wall of each wall means of each package portion, each of said apertures disposed in interconnecting relation between the exterior and interior of the respective package portions.

10. A method as in claim 9 wherein said first package portion is disposed in engaging, interconnecting relation with said second package portion, said apertures of said first package portion and said second package portion being disposed in aligned relation to one another, whereby access to the interior of said package assembly is available through said aligned apertures from the exterior thereof.

11. A method as in claim 9 wherein said first package portion is disposed in engaging, interconnecting relation with said second package portion, said apertures of said first package portion and said second package portion being disposed in non-aligned relation to one another and in adjacent engagement with oppositely disposed wall portions of the respective wall means of the other package portion, whereby access to the interior of said package assembly is prohibited from the exterior thereof through either of the apertures of said first package portion and said second package portion.

12. A method as in claim 1 comprising applying a plurality of said materials to said surface, each of said plurality being a different color.

13. A method as in claim 12 further comprising placing one of said plurality of conductive pigment bearing materials in overlapping relation to one other of said plurality of conductive pigment bearing materials, subsequent to the placing of the other conductive pigment bearing materials.

14. A method as in claim 1 comprising applying said material to said surface by positioning a source of said material in spaced relation to said surface and allowing said material to transfer to said surface through electrostatic attraction.

15. A method as in claim 1 further comprising maintaining said plate in continuous motion while applying said material thereto and ceasing said motion after said drying is substantially complete.

16. A method as in claim 1 further comprising applying a liquid solvent material to said dried dispersed material, whereby said pigment bearing material will be at least partially redistributed on said surface, and drying said redistributed material.

17. A method as in claim 16 further comprising placing an additional charge on the plate while concurrently placing the solvent material thereon, whereby the electro-responsive pigment bearing material is relocated and a new ionic pattern is created by the additional electrostatic charge.

18. A method as in claim 16 further comprising placing an additional charge on the plate subsequent to placing the solvent material thereon, whereby the pigment bearing material is relocated and a new ionic pattern is created by the additional electrostatic charge.

* * * * *